United States Patent [19]

Burgbacher et al.

[11] 4,371,313

[45] Feb. 1, 1983

[54] MINIATURE DIAGONAL BLOWER WITH AXIAL FLOW INLET AND RADIAL FLOW OUTLET

[75] Inventors: Martin Burgbacher; Siegfried Harmsen; Georg Papst, all of St. Georgen, Fed. Rep. of Germany

[73] Assignee: Papst-Motoren K.G., St. Georgen, Fed. Rep. of Germany

[21] Appl. No.: 92,506

[22] Filed: Nov. 8, 1979

[30] Foreign Application Priority Data

Nov. 8, 1978 [CH] Switzerland ..... 11471/78

[51] Int. Cl.[3] ..... F04D 29/42

[52] U.S. Cl. ..... 415/215; 415/206; 415/219 C

[58] Field of Search ..... 415/215, 219 C, 206, 415/219 B, 219 R; 417/423 R

[56] References Cited

U.S. PATENT DOCUMENTS

| | | | |
|---|---|---|---|
| 869,868 | 10/1907 | Spencer | 417/423 R |
| 1,880,665 | 10/1932 | Barker | 415/219 C |
| 2,101,390 | 12/1937 | Gorissen | 415/215 |
| 2,233,825 | 3/1941 | Walsh et al. | 415/215 |
| 3,074,349 | 1/1963 | Zimmermann | 417/423 R |
| 3,490,685 | 1/1970 | Ferri | 415/219 C |
| 3,502,030 | 3/1970 | Bukewihge | 417/423 R |
| 3,574,480 | 4/1971 | Hoepfner | 415/215 |

FOREIGN PATENT DOCUMENTS

| | | | |
|---|---|---|---|
| 2556022 | 6/1976 | Fed. Rep. of Germany | 415/206 |
| 2602624 | 7/1976 | Fed. Rep. of Germany | 415/206 |

*Primary Examiner*—Leonard E. Smith

*Attorney, Agent, or Firm*—Paul M. Craig, Jr.

[57] ABSTRACT

A miniature diagonal blower with axial inward flow and radial outward flow is disclosed. The blower comprises a drive motor having a shaft stub and a motor housing, a fanwheel including a hub fitted with fan blades, said hub being mounted on the shaft stub of the drive motor, a fanwheel housing surrounding the fanwheel without contacting said fanwheel and being provided with recesses for the inward flow and outward flow, a flanged surface associated with the motor housing, said flanged surface projecting on the outward flow side beyond the fanwheel toward the inward flow, said fanwheel housing being provided with support legs distributed about the circumference of the fanwheel in the vicinity of the outward flow, said legs delimiting recesses located between them for the outward flow and being mounted by their soles on said flanged surface means associated with the motor housing with fastening means.

14 Claims, 17 Drawing Figures

MINIATURE DIAGONAL BLOWER WITH AXIAL FLOW INLET AND RADIAL FLOW OUTLET

BACKGROUND AND SUMMARY OF THE INVENTION

The invention relates to a miniature diagonal blower with an axial flow inlet and a radial flow outlet, with a fanwheel including a hub provided with fan blades, the housing surface forming the inner wall of the blade channel expanding such as conically in the flow direction, said hub being mounted on the shaft stub of a drive motor, and with a fanwheel housing surrounding the fanwheel hub and blades, without touching them, and with openings for the inward flow and outward flow.

In a blower of this type known from German Auslegeschrift 16 28 311, the drive motor and the fanwheel housing must be mounted separately. The parts in question are bulky in design, so that considerable space is required.

The goal of the present invention is to provide a blower of the type described hereinabove in such fashion that it can be manufactured simply and can be made compact, so that it may be installed even if the mounting location is limited to dimensions of several centimeters.

This and other objects of the present invention are attained in that in a blower of the aforementioned type a flanged surface means is associated with the drive motor housing, said surface means projecting beyond the fanwheel on the flow outlet side, facing the flow inlet, and by the fact that the fanwheel housing is provided with support legs distributed about the circumference in the vicinity of the flow outlet, said legs delimiting recesses or openings located between them for the outward flow, and with their sole surfaces mounted on the flanged surface means associated with the drive motor housing, with fastening means inserted through the support legs and the housing.

In manufacturing complex electronic equipment, it is possible for hot spots to develop unforeseeably at critical points under certain circumstances, said hot spots being capable of being cooled sufficiently by local, directed ventilation without necessarily having to cool the entire equipment. A miniature diagonal blower according to the present invention is exceptionally well suited for such applications.

The diagonal blower of the present invention gives especially favorable flow patterns for cramped installation conditions and allows the use of miniature motors which are available at low cost as mass produced articles.

These and other objects, features and advantages of the present invention will become more apparent from the following description when taken in connection with the accompanying drawing which shows, for purposes of illustration only, several embodiments in accordance with the present invention.

The invention will now be described with reference to the attached drawing.

DETAILED DESCRIPTION OF THE DRAWINGS

Figure 1A:
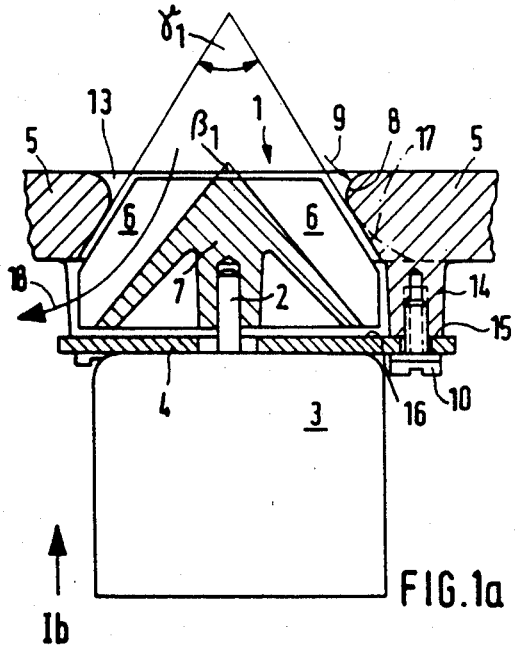
FIG. 1 shows a first embodiment, shown in cross section at (a) and from below in (b).
Figure 1B:
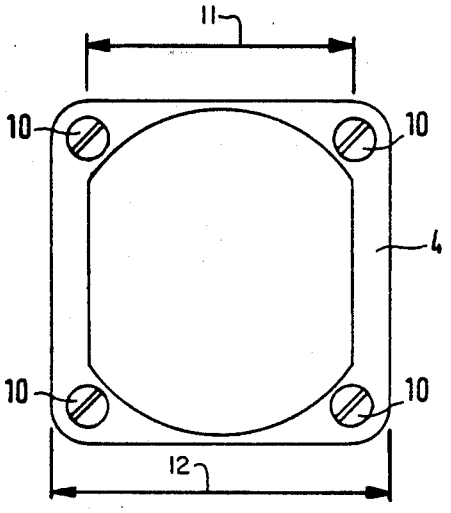

In FIG. 1, the fanwheel is designated 1, said fanwheel consisting of hub 7 and blades 6 mounted thereon. Fanwheel 1 is mounted on shaft stub 2 of electric drive motor 3. Only the motor housing of the electric drive motor is visible, with a mounting flange 4 attached to its end. Blade housing 5 is mounted on the flanged surface of mounting flange 4 which faces away from the motor. Fanwheel housing 5 consists of a thick mounting plate, shown only in part, and provided with a recess 13 for the incoming flow. Fanwheel housing 5 comprises four support legs 14, supported with their soles 15 on mounting surface 16 of mounting flange 4 and screwed to the flange by screws 10. The edge 8 of recess 13 is curved sharply in the outer area (shown at the top in FIG. 1*a*). Arrow 9 shows this curvature. This curvature terminates in a conical opening with an aperture angle $\gamma 1$. No further curvature is provided in the conical area, but, in contrast to the drawing, the curvature can also continue in the conical area, preferably with an increasing radius of curvature, as indicated at the right in FIG. 1*a* by the dot-dash line 17.

Mounting flange 4 is square, and screwed down at the four corners by screws 10. It is provided with appropriate mounting holes for this purpose. The spacing of these mounting holes is indicated by double arrow 11. Mounting flange 4 is the widest part of the blower and its external dimensions are indicated by double arrow 12, which is only a slightly larger than double arrow 11. Screws 10 are located close to the motor. Fanwheel 1 is made sufficiently large that the free space between supporting legs 14 is used for the most part. Four recesses for the outward flow, corresponding to the direction of arrow 18, are provided between the four support legs 14 on all sides.

An odd number of blades 6 is provided, preferably seven blades. The blade 6 shown at the left is in the plane of the drawing and extends into the recess for the outward flow; the blade shown at the right is at an angle to the plane of the drawing and is therefore visible only in its shortened projection. The fanwheel diameter is slightly larger than that of motor 3. Hub 7 is conical, with a conical angle $\beta_1$ of approximately 70°. The aperture angle $\gamma_1$ for edge 8 is slightly smaller and is 65°. The envelope of blades 6 is a conical envelope.

If mounting considerations make it necessary to locate screws 10 near fanwheel 1, the outer edges of blades 6 need not extend along a straight line but advantageously may be made curved or bent, so that the blades can utilize the available space to the maximum extent possible, as shown in FIG. 1*a*. Hub 7 extends axially almost up to mounting flange 4.

With the blower shown in FIG. 1, a radial diffuser effect is achieved on the outlet side, because the recess for the outward flow, except for support legs 14, extends over the entire circumference of the fanwheel.

Figure 2A:
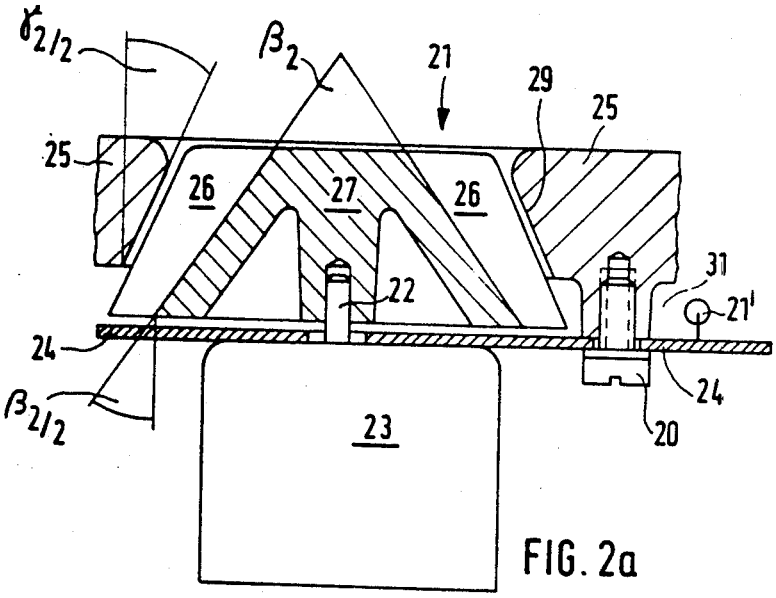
FIG. 2 is a second embodiment, shown in cross section at (a) and from below at (b).
Figure 2B:
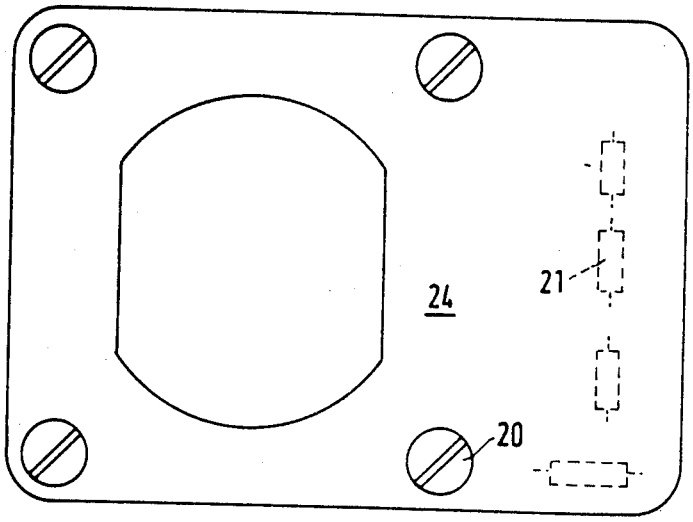
Figure 6A:
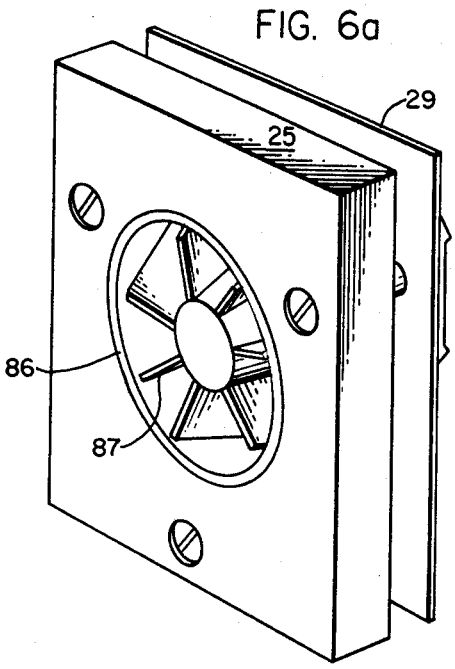
FIG. 6 shows five further embodiments in perspective views at (a) through (e).

FIG. 2 shows an embodiment very similar to that in FIG. 1. Hub 27 has the external shape of a truncated cone and mounting flange 24 is larger than mounting flange 4 from FIG. 1, so that sufficient space remains so that the outer edges of blades 26 can extend along straight lines. Fanwheel housing 25 rests upon mounting flange 24 with its supporting legs and is screwed to the latter, for example with screws 20. The mounting flange projects far above the screw connections on one side and serves as a board for the circuit elements, for example circuit element 21 of an electrical circuit, whose circuit elements must be cooled. Housing 25 provides an outer jacket 29 for the flow channel which extends relatively far in the axial direction, said channel expanding in a conical fashion at aperture angle $\gamma_2$. The aperture angle of the hub $\beta_2$ is larger. Once again, as shown in the text pertaining to FIG. 1, a radial diffuser is produced. The outlet cross section for the flow from the individual blade channels is frustroconical. As in the embodiment shown in FIG. 1, the fanwheel housing can also be part of a device to be ventilated or, by contrast with the embodiments shown in FIGS. 1 and 2, can be a separate, ready-made housing, as shown in FIG. 6*a*, for example. In the embodiment shown in FIG. 2, the diameter of the drive motor is smaller than that of the fanwheel, because the fanwheel housing 25 offers more space.

Figure 3B:
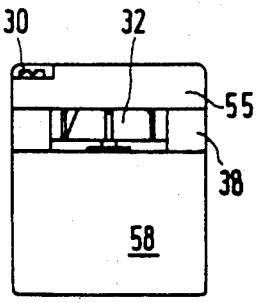
FIG. 3 is a third embodiment, shown in cross section at (a) shown in side elevation at (b) and from above at (c).
Figure 3A:
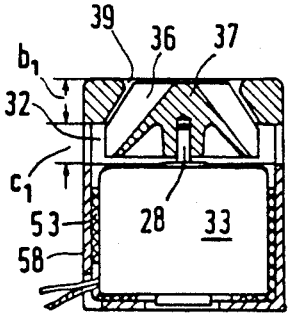
Figure 3C:
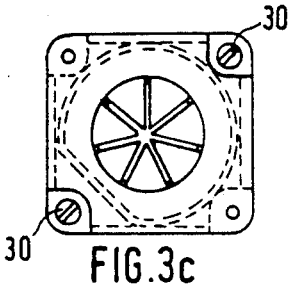

In the embodiment shown in FIG. 3, drive motor 33 has a sheet metal housing, together with which it is mounted in an outer housing 58, with a felt or rubber layer 53 imposed therebetween. Hub 37 is mounted on shaft stub 28, said hub being provided with seven blades 36 uniformly distributed about its circumference. Fanwheel housing 55, which fits tightly around blades 36, is screwed to outer housing 58 by means of support legs 38, screwed in place with screws 30. Two of the support legs are not screwed down and are cemented to outer housing 58 or fanwheel housing 55. Recesses 32 for the outward flow are provided between support legs 38, with a total of one recess on each side.

Outer housing 58 and fanwheel housing 55 have equal square cross sections. The recess for the inward flow is coaxial to the blower axis in fanwheel housing 55 and is represented by 39. Blades 36 are flat and all extend in a radial plane.

Recesses 32 for the outward flow, provided on all four sides of the square shape, can be blocked optionally by a glued-on paper strip or the like, so that the flow must be concentrated in the recess or recesses which is/are still open. The diameter of the fanwheel in the embodiment shown in FIG. 3 is approximately the same size as the motor diameter.

The embodiment shown in FIG. 4 differs from the embodiment shown in FIG. 3 in only a few small details, which will be described in detail hereinbelow. Moreover, those parts of the two embodiments which are the same and correspond to one another are given the same reference numbers in FIG. 4 as in FIG. 3, but with 100 added.

Figure 4B:
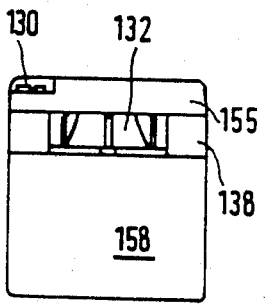
FIG. 4 is a fourth embodiment, shown in cross section at (a), in side elevation at (b), and from above at (c).
Figure 4A:
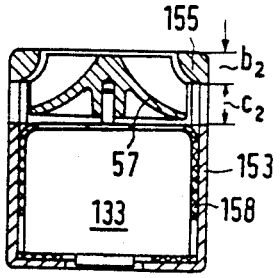
Figure 4C:
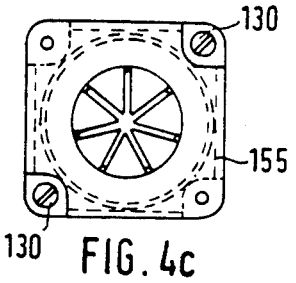

According to FIG. 4, the height of the fanwheel housing as indicated by double arrow b2 is slightly smaller than that indicated by double arrow b1 in the embodiment shown in FIG. 3. The height of the support legs in both embodiments, as indicated by double arrows c1 and c2, is approximately the same. In the embodiment shown in FIG. 3, the outer surface of hub 37 is a circular cone, while in the embodiment shown in FIG. 4, corresponding to curved line 57, it is paraboloid. Moreover, the tip of the hub as shown in FIG. 4 is shortened to a greater extent than the hub shown in FIG. 3. Thus, the height indicated by double arrow b2 is less than the height indicated by double arrow b1, without this being accomplished at the expense of an excessive reduction of the blower power.

The recesses for the inward flow are of equal size in the two embodiments, and the blades likewise have approximately the same area in the two embodiments, due to the convex shape of housing 55 in FIG. 3, designed to fit the outer edge of the blade.

The embodiments shown in FIGS. 3 and 4 are both cuboids, but the embodiment in FIG. 3 is a slightly longer cuboid than that in FIG. 4.

Figure 5A:
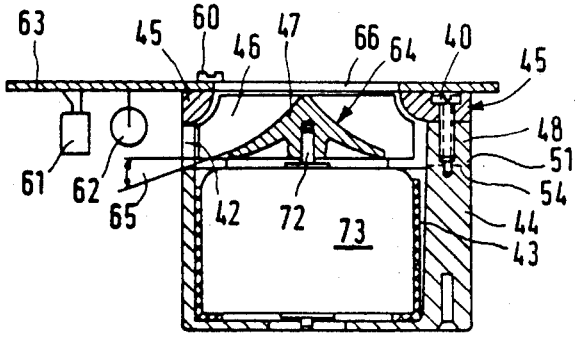
FIG. 5 is another embodiment shown in cross section at (a), and shown from above at (b)

In the embodiment shown in FIG. 5, the drive motor is represented by 73 and the latter is mounted in motor housing 44 with interposition of damping material 43. Fanwheel 64, whose hub is represented by 47, is mounted on motor shaft stub 72, projecting from motor housing 44. Hub 47 has a paraboloid outer surface, and is pointed at the flow inlet side. On the outlet side, due to its paraboloid shape, the hub outer surface extends in the flow outlet direction for a distance such that only an acute angle 65 of 0° to 20°, 15° in the embodiment, remains between the edge area of this outer surface and the radial plane. The upper edge area of motor housing 44 serves as a flanged surface 54, upon which mounting legs 48 of the fanwheel housing rest with their soles 51. The annular blade housing 45 is joined with these supporting legs on motor housing 44 by means of screws 40.

The blades are designated 46. There are a total of 7 blades, which are flat and extend in a radial plane, and have their outer edges close to a convex rounded part of the fanwheel housing. The recess for the flow inlet is designated 66. A corresponding recess in a circuit board 63 is provided flush with this recess, said board being screwed to fanwheel housing 45 and equipped with circuit elements 61, 62, which form part of an electrical device and must be cooled, and therefore are located in the path of the emergent flow emitted from recess 42. The entire embodiment has a cuboid, nearly cubic outer shape, formed by the outer contours of motor housing 44 and fanwheel housing 45, and a recess corresponding to recess 42 is provided between the supporting legs at the corners for the outward flow, said recess in turn being optionally closable by applying a material impermeable to air.

Figure 5B:
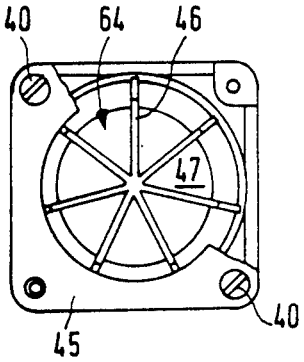

FIG. 5*b* shows that fanwheel 64 has 7 flat radially directed blades 46 distributed uniformly around the circumference. This is especially advantageous for such miniature blowers. If, instead of the 7 blades, only 5 blades are provided—an even number of blades cannot be used because of the noise which they generate—, there will be a pronounced decrease in the quality of the delivery, and with 9 blades, the blades themselves will take up too much of the cross section of the available flow channel. The fact that the blades are flat and directed radially does not produce any negative effects upon quality in miniature blowers, but results in a considerable simplification of fanwheel manufacture.

The embodiment shown in FIG. 6*a* is very similar to that shown in FIG. 2, but the fanwheel housing 25 and the mounting flange 29 discharge much further in all directions, something which is advantageous for the desired radial diffuser effect. The parts of mounting flange 29 which project beyond motor 85 can be used to mount the blower on a mounting panel. In FIG. 6*a*, the recess for the inward flow is designated 86 and the fanwheel, 87.

Figure 6B:
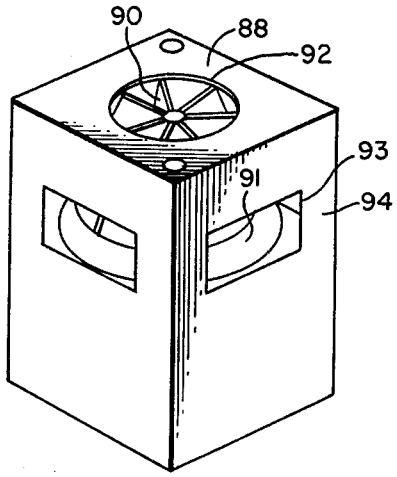

The embodiment shown in FIG. 6*b* is very similar to that in FIG. 3. Reference No. 88 has been used for the fanwheel housing, while 89 represents the outer motor housing, 90 the fanwheel, and 91 the motor. Fanwheel housing 88 includes a recess 92 for the inward flow and a recess 93 on each side for the outward flow. The recesses for the inward flow are located between supporting legs 94 at the corners of fanwheel housing 88, which rests on the end of the motor housing 89 which serves as a flanged surface with the soles of its supporting legs and is screwed firmly in place by diagonally mounted screws which are passed through the supporting legs.

Figure 6C:
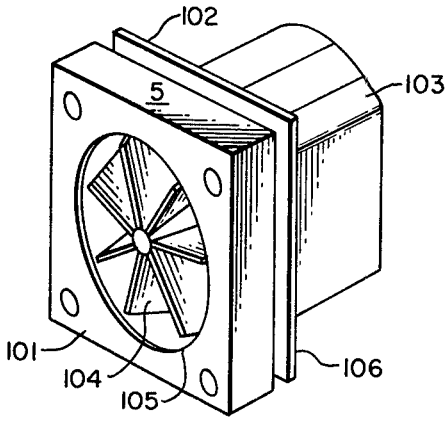
Figure 6D:
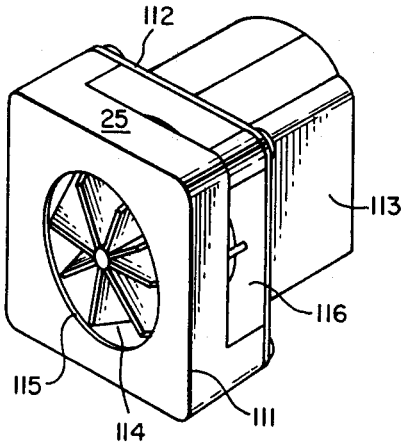

The embodiments shown in FIGS. 6*c* and 6*d* are very similar to that shown in FIG. 6*a*. In FIG. 6*c*, 101 represents the fanwheel housing, 102 the mounting flange, 103 the motor, 104 the fanwheel, 105 the recess for the inward flow, and 106 the recess for the outward flow.

In the embodiment shown in FIG. 6*d*, 111 represents the fanwheel housing, 112 the mounting flange, 113 the motor, 114 the fanwheel, 115 the recess for the inward flow, and 116 the recess for the outward flow.

Figure 6E:
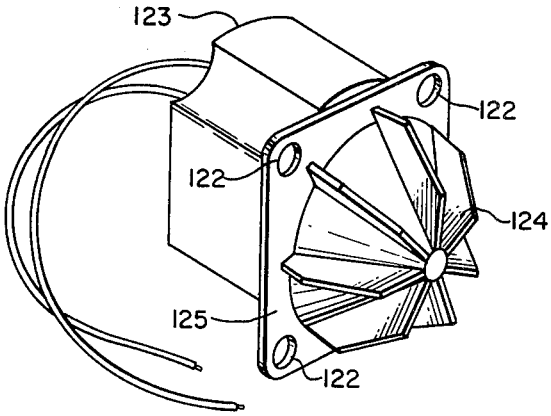

The embodiment shown in FIG. 6*e* consists only of a motor 123 on whose shaft stub fanwheel 124 is mounted. Mounting flange 125 is mounted on the motor housing, said flange extending beyond the contour of fanwheel 124 and having mounting holes 122 at the corners. The embodiment shown in FIG. 6*e* is used in a device in which a circuit board or the like assumes the function of the fanwheel housing, missing here.

Blowers according to the invention are especially advantageous in the form of miniature blowers, and the dimensions given below are preferred for them.

In the embodiment shown in FIG. 6*a*, the external dimensions of the fanwheel housing 25 are 60×60 mm.

In the embodiment shown in FIG. 6*b*, the outside dimensions of the cuboid are 32×32×35 mm.

In the embodiments shown in FIGS. 6*c* and 6*d*, the square dimensions of the fanwheel housing are 32×32 mm and the height is 35 mm. The other dimensions can be obtained from the drawings, because they are to scale.

It should also be pointed out that in the embodiment shown in FIG. 6*c*, the thickness of recess 106 is ¼ of the axial height of fanwheel housing 101.

Preferably, the central flow direction in the blade channels is at an angle of between 30° and 50° to the blower axis. Preferably, the radius of curvature of the edge of the recess for the inward flow is greater than 1/10 of the axial projection of the length of one blade.

We claim:

1. A miniature diagonal blower with axial inward flow and radial outward flow comprising a drive motor having a shaft stub and a motor housing, said shaft stub being rotatable about a fan axis, a fanwheel including a hub fitted with fan blades, said hub being mounted on the shaft stub of the drive motor for rotation about said fan axis, a fanwheel housing surrounding the fanwheel without contacting said fanwheel and being provided with recesses for the inward flow and outward flow, a flanged surface means associated with the motor housing, said flanged surface means projecting on the outward flow side beyond the fanwheel and being located such that said hub extends axially almost up to said flanged surface means, said fanwheel housing being provided with support legs distributed about the circumference of the fanwheel in the vicinity of the outward flow, said legs delimiting recesses located between them for the outward flow and being mounted by their soles on said flanged surface means associated with the motor housing with fastening means, and wherein said fanwheel housing and said motor housing are configured such that said blower has a square cross section in the direction perpendicular to the fan axis and a rectangular cross section along the fan axis.

2. The miniature diagonal blower according to claim 1, wherein said blades extend over at least substantially the entire cross section of the flow channel available inside the fanwheel housing to a point close to said fanwheel housing.

3. The miniature diagonal blower according to claim 1, wherein said flanged surface means is part of an external motor housing, in which the drive motor, equipped with an inner housing, is inserted with interposition of noise-damping material.

4. The miniature diagonal blower according to claim 3, wherein the external motor housing together with the fanwheel housing form a blower having the form of a cuboid.

5. The miniature diagonal blower according to claim 1, wherein the central flow direction in the blade channels of the blower is inclined at an angle between 30° and 50° to the blower axis.

6. The miniature diagonal blower according to claim 1, wherein said fanwheel housing is provided with mounting holes which are located close to the circumference of the fan blades and wherein recesses in said fanwheel housing for the outward flow have the shape of segments of a circularly cylindrical jacket.

7. The miniature diagonal blower according to claim 1, wherein said fastening means are inserted through the support legs and the fanwheel housing.

8. The miniature diagonal blower according to claim 1, wherein said fastening means are located in the corners of the square cross section of the blower as viewed in the direction perpendicular to the fan axis.

9. The miniature diagonal blower according to claim 1, wherein a recess in said fanwheel housing for the inward flow has a radius of curvature which is greater than 1/10 of the axial projection of the length of a blade.

10. The miniature diagonal blower according to claim 9, wherein the curvature of the recess in said fanwheel housing for the inward flow is extended in the flow direction into the fanwheel housing with an increasing radius of curvature.

11. The miniature diagonal blower according to claim 1, wherein said hub is pointed on the flow inlet side.

12. The miniature diagonal blower according to claim 1, wherein the outer surface of the hub forms the inner wall of the blade channels of the blower and expands conically in the direction of flow.

13. The miniature diagonal blower according to claim 1, wherein the outer surface of the hub forms the inner wall of the blade channels of the blower and is paraboloid expanding in the direction of flow with its end at the flow outlet side at an acute angle of between 0° to 20° relative to the radial plane of the fanwheel.

14. The miniature diagonal blower according to claim 1, 11, 12 or 13, wherein said fanwheel has seven blades which are flat and extend in an axial plane.

* * * * *